US006585143B1

(12) United States Patent
Schultz

(10) Patent No.: US 6,585,143 B1
(45) Date of Patent: Jul. 1, 2003

(54) ANCHOR SETTING DEVICE

(76) Inventor: John M. Schultz, 837 Twp Rd., #267, Amsterdam, OH (US) 43903

( * ) Notice: Subject to any disclaimer, the term of this patent is extended or adjusted under 35 U.S.C. 154(b) by 176 days.

(21) Appl. No.: 09/797,662

(22) Filed: Mar. 5, 2001

(51) Int. Cl.[7] ..... B25C 7/00
(52) U.S. Cl. ..... 227/147; 227/156; 227/142; 173/128
(58) Field of Search ..... 227/147, 156, 227/142; 173/21, 128

(56) References Cited

U.S. PATENT DOCUMENTS 1,068,211 A * 7/1913 Bocorselski ..... 408/202
2,231,864 A * 2/1941 Abel ..... 408/202
3,017,643 A * 1/1962 Lehde ..... 408/202
3,290,822 A * 12/1966 Mauget ..... 47/57.5
3,336,611 A * 8/1967 Schepp ..... 7/158
4,315,551 A * 2/1982 Iannone ..... 173/128
4,521,145 A * 6/1985 Bieler ..... 409/218
4,637,539 A 1/1987 Turcott et al.
4,867,249 A * 9/1989 Watkins et al. ..... 173/29
4,890,779 A 1/1990 Giannuzzi
4,984,346 A * 1/1991 Vorhauer ..... 29/277
5,030,043 A * 7/1991 Fischer et al. ..... 408/241 R
5,152,649 A 10/1992 Popp
D357,855 S 5/1995 Keith et al.
5,575,600 A 11/1996 Giannuzzi et al.
5,669,915 A * 9/1997 Caspar et al. ..... 606/96
5,680,689 A * 10/1997 Holladay ..... 29/426.5
5,961,024 A * 10/1999 Wright, Jr. ..... 227/147
5,979,913 A 11/1999 Kosik et al.

* cited by examiner

*Primary Examiner*—Rinaldi I. Rada
*Assistant Examiner*—Louis Tran

(57) ABSTRACT

An anchor setting device for setting a concrete anchor into concrete and leaving a desired length exposed. The anchor setting device includes a body having a bore extending through the body. The body has a first end and a second end. The bore of the body is threaded for releasably receiving a threaded end of a concrete anchor. The body has a slot extending through a side of the body facilitating insertion of the threaded end of the concrete anchor a desired length into the bore. The first end of the body is designed for being struck by an impact device for driving the concrete anchor into a hole in an anchoring surface when the first end of the body is struck by the impact device. The second end of said body is designed for abutting against the anchoring surface when the concrete anchor is driven into the hole.

5 Claims, 3 Drawing Sheets

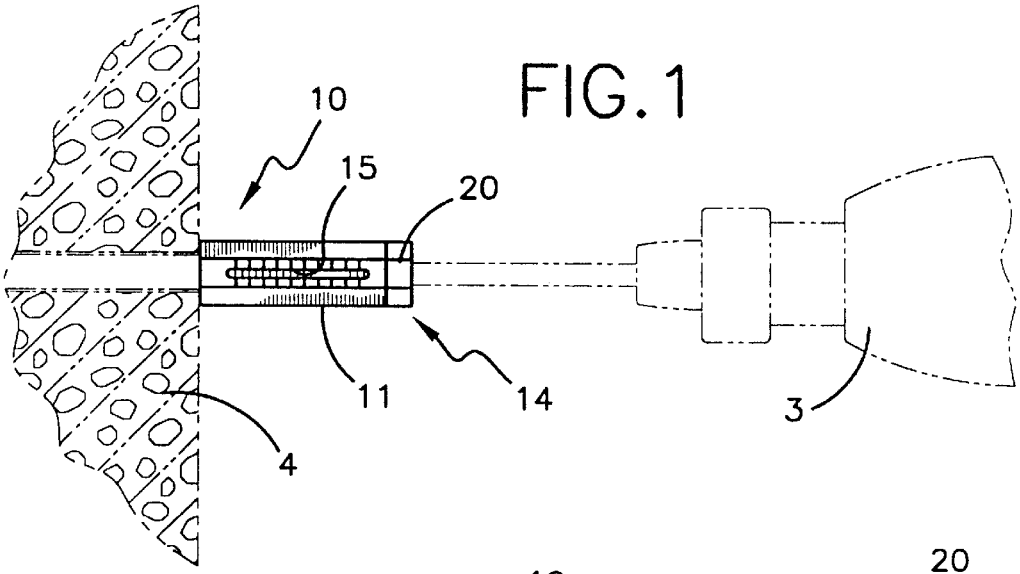
FIG. 1
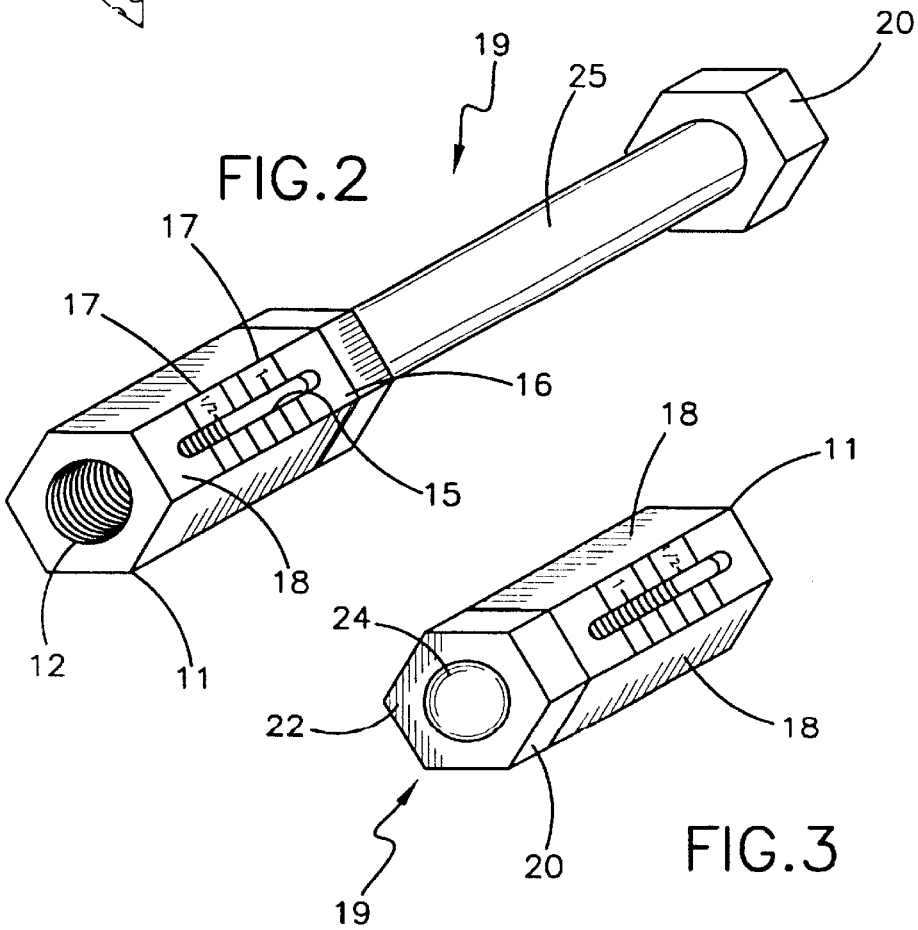
FIG. 2
FIG. 3

ANCHOR SETTING DEVICE

BACKGROUND OF THE INVENTION

1. Field of the Invention

The present invention relates to devices for setting anchors and more particularly pertains to a new anchor setting device for setting a concrete anchor into concrete and leaving a desired length exposed.

2. Description of the Prior Art

The use of devices for setting anchors is known in the prior art. More specifically, devices for setting anchors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,637,539; U.S. Pat. No. 5,979,913; U.S. Pat. No. 4,480,779; U.S. Pat. No. 5.512,649; U.S. Pat. No. 5,575,600; and U.S. Pat. No. Des. 357,855.

While these devices fulfill their respective, particular objectives and requirements, the aforementioned patents do not disclose a new anchor setting device. The inventive device includes a body having a bore extending through the body. The body has a first end and a second end. The bore of the body is threaded whereby the bore is designed for releasably receiving a threaded end of a concrete anchor. The body has a slot extending through a side of the body whereby the bore is viewable through the slot in the side of the body designed for facilitating insertion of the threaded end of the concrete anchor a desired length into the bore. The first end of the body is designed for being struck by an impact device whereby the body is designed for driving the concrete anchor into a hole in an anchoring surface when the first end of the body is struck by the impact device. The second end of said body is adapted for abutting against the anchoring surface when the concrete anchor is driven into the hole whereby the threaded end of the concrete anchor extends the desired length from the hole in the anchoring surface.

In these respects, the anchor setting device according to the present invention substantially departs from the conventional concepts and designs of the prior art, and in so doing provides an apparatus primarily developed for the purpose of setting a concrete anchor into concrete and leaving a desired length exposed.

SUMMARY OF THE INVENTION

In view of the foregoing disadvantages inherent in the known types of devices for setting anchors now present in the prior art, the present invention provides a new anchor setting device construction wherein the same can be utilized for setting a concrete anchor into concrete and leaving a desired length exposed.

The general purpose of the present invention, which will be described subsequently in greater detail, is to provide a new anchor setting device apparatus and method which has many of the advantages of the devices for setting anchors mentioned heretofore and many novel features that result in a new anchor setting device which is not anticipated, rendered obvious, suggested, or even implied by any of the prior art devices for setting anchors, either alone or in any combination thereof.

To attain this, the present invention generally comprises a body having a bore extending through the body. The body has a first end and a second end. The bore of the body is threaded whereby the bore is designed for releasably receiving a threaded end of a concrete anchor. The body has a slot extending through a side of the body whereby the bore is viewable through the slot in the side of the body designed for facilitating insertion of the threaded end of the concrete anchor a desired length into the bore. The first end of the body is designed for being struck by an impact device whereby the body is designed for driving the concrete anchor into a hole in an anchoring surface when the first end of the body is struck by the impact device. The second end of said body is adapted for abutting against the anchoring surface when the concrete anchor is driven into the hole whereby the threaded end of the concrete anchor extends the desired length from the hole in the anchoring surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new anchor setting device apparatus and method which has many of the advantages of the devices for setting anchors mentioned heretofore and many novel features that result in a new anchor setting device which is not anticipated, rendered obvious, suggested, or even implied by any of the prior art devices for setting anchors, either alone or in any combination thereof.

It is another object of the present invention to provide a new anchor setting device which may be easily and efficiently manufactured and marketed.

It is a further object of the present invention to provide a new anchor setting device which is of a durable and reliable construction.

An even further object of the present invention is to provide a new anchor setting device which is susceptible of a low cost of manufacture with regard to both materials and labor, and which accordingly is then susceptible of low prices of sale to the consuming public, thereby making such anchor setting device economically available to the buying public.

Still yet another object of the present invention is to provide a new anchor setting device which provides in the apparatuses and methods of the prior art some of the advantages thereof, while simultaneously overcoming some of the disadvantages normally associated therewith.

Still another object of the present invention is to provide a new anchor setting device for setting a concrete anchor into concrete and leaving a desired length exposed.

Yet another object of the present invention is to provide a new anchor setting device which includes a body having a bore extending through the body. The body has a first end and a second end. The bore of the body is threaded whereby the bore is designed for releasably receiving a threaded end of a concrete anchor. The body has a slot extending through a side of the body whereby the bore is viewable through the slot in the side of the body designed for facilitating insertion of the threaded end of the concrete anchor a desired length into the bore. The first end of the body is designed for being struck by an impact device whereby the body is designed for driving the concrete anchor into a hole in an anchoring surface when the first end of the body is struck by the impact device. The second end of said body is adapted for abutting against the anchoring surface when the concrete anchor is driven into the hole whereby the threaded end of the concrete anchor extends the desired length from the hole in the anchoring surface.

Still yet another object of the present invention is to provide a new anchor setting device that facilitates the setting of a concrete anchor in concrete.

Even still another object of the present invention is to provide a new anchor setting device that allows a concrete anchor to be set into concrete leaving a desired length of the concrete anchor exposed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein FIG. 1 is a side elevational view of a new anchor setting device according to the present invention.

FIG. 2 is a perspective view of the present invention.

FIG. 3 is a perspective view of an embodiment of the present invention.

DESCRIPTION OF THE PREFERRED EMBODIMENT

Figure 4:
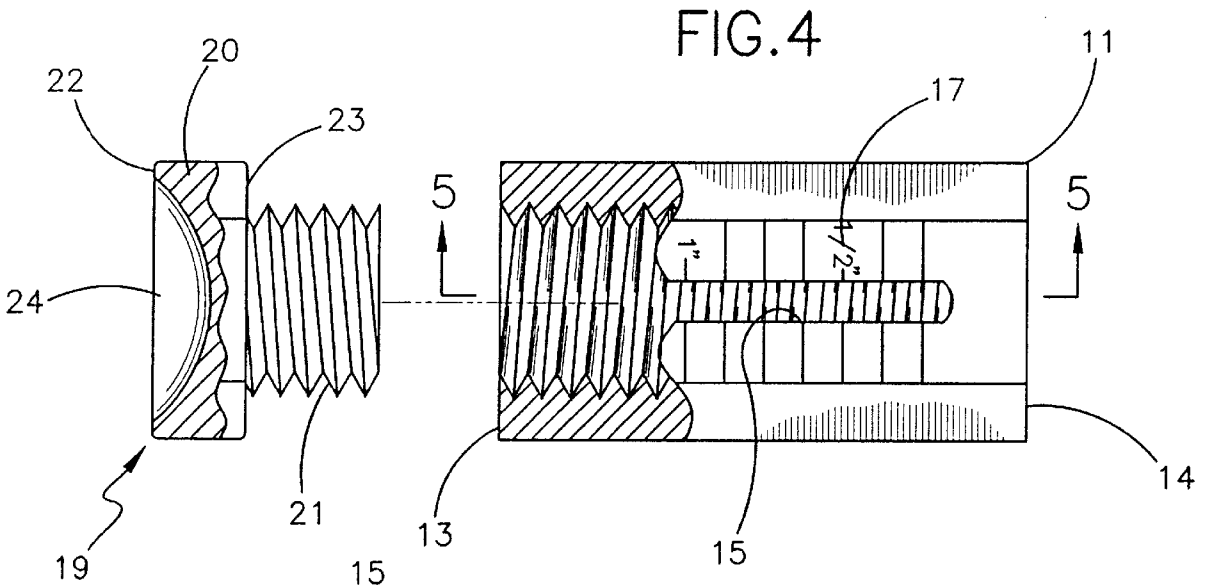
FIG. 4 is a partial cross-sectional view of the present invention.
Figure 5:
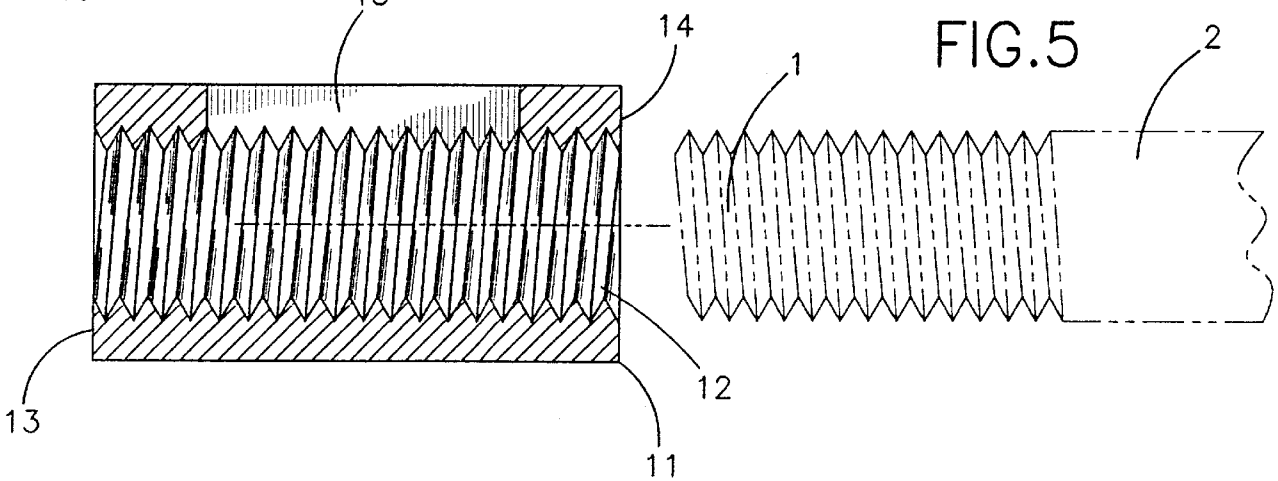
FIG. 5 is a cross-sectional view of the present invention taken along line 5—5 in FIG. 4.
Figure 6:
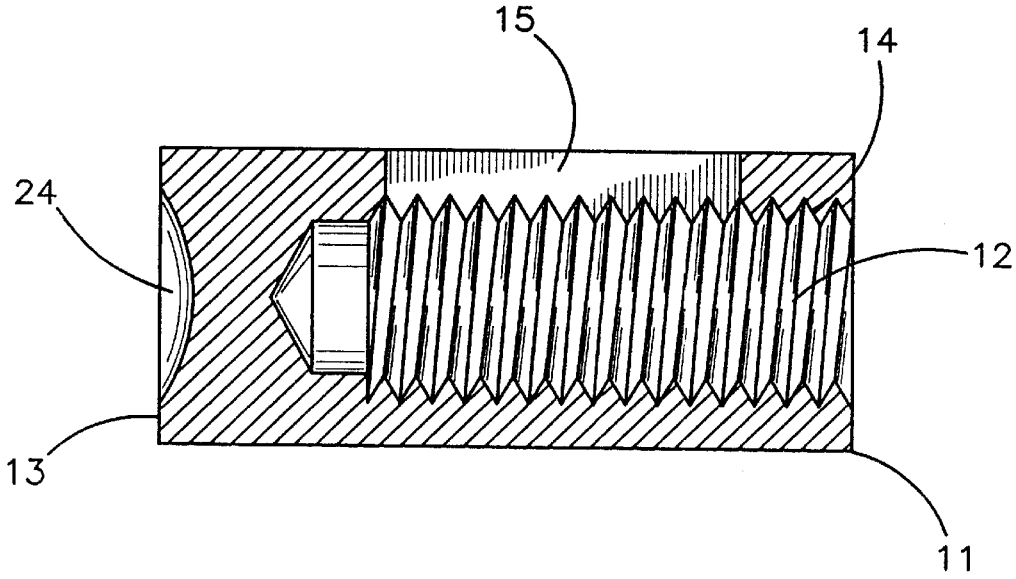
FIG. 6 is a cross-sectional view of an embodiment of the present invention.

With reference now to the drawings, and in particular to FIGS. 1 through 6 thereof, a new anchor setting device embodying the principles and concepts of the present invention and generally designated by the reference numeral 10 will be described.

As best illustrated in FIGS. 1 through 6, the anchor setting device 10 generally comprises a body 11 having a bore 12 extending through the body 11. The body 11 has a first end 13 and a second end 14. The bore 12 of the body 11 is threaded such that the bore 12 is designed for releasably receiving a threaded end 1 of a concrete anchor 2. The body 11 has a slot 15 extending through a side 16 of the body 11. The bore 12 is viewable through the slot 15 in the side 16 of the body 11 whereby the slot 15 is designed for facilitating insertion of the threaded end 1 of the concrete anchor 2 a desired length into the bore 12. The body has a length of approximately 1 ¾ inches and a width of about ⅝ inches.

The first end 13 of the body 11 is designed for being struck by an impact device 3, such as a hammer or hammer drill, whereby the body 11 is designed for driving the concrete anchor 2 into a hole in an anchoring surface 4 when the first end 13 of the body 11 is struck by the impact device 3. The second end 14 of the body 11 is designed for abutting against the anchoring surface 4 when the concrete anchor 2 is driven into the hole. The threaded end 1 of the concrete anchor 2 extends the desired length from the hole in the anchoring surface 4.

The side 16 of the body 11 has a plurality of indicia 17 positioned adjacent the slot 15 in the side 16 of the body 11. The indicia 17 are designed for indicating a desired depth for the threaded end 1 of the concrete anchor 2 to penetrate the body 11. The side 16 of the body 11 has a plurality of faces 18 whereby diametrically opposed faces 18 are parallel to each other for facilitating gripping of the body 11.

A striking assembly 19 is removably couplable to the body 11 whereby the striking assembly 19 abuts the first end 13 of the body 11. The striking assembly 19 has an anvil 20 and an engaging portion 21. The anvil has a depth of approximately ¼ inch. The anvil 20 has a striking face 22 and a back face 23. The engaging portion 21 outwardly extends from the back face 23 of the anvil 20 whereby the engaging portion 21 engages the bore 12 of the body 11 whereby the back face 23 of the anvil 20 abuts the first end 13 of the body 11. The striking face 22 has a concave portion 24 designed for receiving an end of drill bit of a hammer drill whereby the concave portion 24 is designed to prevent slipping of the drill bit off of the anvil 20. The striking assembly 19 has an extension portion 25 coupled between the engaging portion 21 and the anvil 20 for extending the anvil 20 away from the body 11. The extension portion has a length of approximately 4 and ½ inches. In an alternative, the striking assembly 19 and body 11 are integrated to form a one piece unit.

In use, the user threads a concrete anchor into the body to a desired length viewed through the slot in the body. A user then strikes the striking assembly with a hammer and drives the concrete anchor into the concrete. A user can also use an impact hammer to drive in the concrete anchor by placing the drill bit into the concave portion of the striking assembly to prevent the drill bit from slipping while the impact hammer drives the concrete anchor into the concrete. The body is then removed from the concrete anchor leaving the concrete anchor extending the desired length from the concrete.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An anchor setting device for setting concrete anchors, the anchor setting device comprising:

a body having a bore extending through said body, said body having a first end and a second end;

said bore of said body being threaded such that said bore is adapted for releasably receiving a threaded end of the concrete anchor;

said body having a slot extending through a side of said body such that said bore is viewable through said slot in said side of said body adapted for facilitating insertion of the threaded end of the concrete anchor a desired length into said bore;

said first end of said body being adapted for being struck by an impact device such that said body is adapted for driving the concrete anchor into a hole in an anchoring surface when said first end of said body is struck by an impact device, said second end of said body being adapted for abutting against the anchoring surface when the concrete anchor is driven into the hole whereby the threaded end of the concrete anchor extends said desired length from the hole in the anchoring surface; and a striking assembly being removably couplable to said body such that said striking assembly abuts said first end of said body, said striking assembly having an anvil and an engaging portion, said anvil having a striking face and an back face, said engaging portion outwardly extending from said back face of said anvil such that said engaging portion is for engaging said bore of said body whereby said back face of said anvil abuts said first end of said body, said striking face having a concave portion such that said concave portion is adapted for receiving an end of drill bit of a hammer drill whereby said concave portion is adapted to prevent slipping of the drill bit off of said anvil, said concave portion comprising an arcuate face extending into said striking assembly from said striking face of said striking assembly such that said arcuate face is adapted for inhibiting the drill bit of the hammer drill from biting into said striking assembly should the hammer drill become off centered.

2. The anchor setting device as set forth in claim 1, wherein said side of said body has a plurality of indicia positioned adjacent said slot in said side of said body, said indicia being adapted for indicating a desired depth for the threaded end of the concrete anchor to penetrate said body.

3. The anchor setting device as set forth in claim 1, wherein said side of said body has a plurality of faces such that diametrically opposed faces are parallel to each other for facilitating gripping of said body.

4. The anchor setting device as set forth in claim 1, wherein said striking assembly has an extension portion coupled between said engaging portion and said anvil such that said extension portion is for extending said anvil away from said body.

5. An anchor setting device for setting concrete anchors, the anchor setting device comprising:

a body having a bore extending through said body, said body having a first end and a second end;

said bore of said body being threaded such that said bore is adapted for releasably receiving a threaded end of the concrete anchor;

said body having a slot extending through a side of said body such that said bore is viewable through said slot in said side of said body adapted for facilitating insertion of the threaded end of the concrete anchor a desired length into said bore;

said first end of said body being adapted for being struck by an impact device such that said body is adapted for driving the concrete anchor into a hole in an anchoring surface when said first end of said body is struck by an impact device, said second end of said body being adapted for abutting against the anchoring surface when the concrete anchor is driven into the hole whereby the threaded end of the concrete anchor extends said desired length from the hole in the anchoring surface;

said side of said body having a plurality of indicia positioned adjacent said slot in said side of said body, said indicia being adapted for indicating a desired depth for the threaded end of the concrete anchor to penetrate said body;

said side of said body having a plurality of faces such that diametrically opposed faces are parallel to each other for facilitating gripping of said body;

a striking assembly being removably couplable to said body such that said striking assembly abuts said first end of said body, said striking assembly having an anvil and an engaging portion, said anvil having a striking face and an back face, said engaging portion outwardly extending from said back face of said anvil such that said engaging portion is for engaging said bore of said body whereby said back face of said anvil abuts said first end of said body, said striking face having a concave portion such that said concave portion is adapted for receiving an end of drill bit of a hammer drill whereby said concave portion is adapted to prevent slipping of the drill bit off of said anvil, said concave portion comprising an arcuate face extending into said striking assembly from said striking face of said striking assembly such that said arcuate face is adapted for inhibiting the drill bit of the hammer drill from biting into said striking assembly should the hammer drill become off centered; and said striking assembly having an extension portion coupled between said engaging portion and said anvil such that said extension portion is for extending said anvil away from said body.

* * * * *